United States Patent [19]

Gall et al.

[11] 4,328,853

[45] May 11, 1982

[54] FOLDING SCREEN FOR LIGHT-PERMEABLE SKYLIGHTS AND THE LIKE

[76] Inventors: George R. Gall, 45 Farwood Dr., Chagrin Falls, Ohio 44022; Charles R. Gates, 15070 Hill Dr., Novelty, Ohio 44072

[21] Appl. No.: 106,357

[22] Filed: Dec. 21, 1979

[51] Int. Cl.[3] ..... F05D 15/26

[52] U.S. Cl. ..... 160/183; 49/276; 160/84 R; 160/206

[58] Field of Search ..... 160/183, 84 R, 199, 160/206; 49/463, 323

[56] References Cited

U.S. PATENT DOCUMENTS

| | | | |
|---|---|---|---|
| 1,889,221 | 11/1932 | Schleicher et al. | 49/463 X |
| 3,205,935 | 9/1965 | Cayton | 160/183 |
| 3,466,830 | 9/1969 | Smith | 160/183 X |
| 3,924,671 | 12/1975 | Gates | 160/183 |

FOREIGN PATENT DOCUMENTS

| | | | |
|---|---|---|---|
| 397546 | 8/1933 | United Kingdom | 160/206 |
| 958497 | 5/1964 | United Kingdom | 160/183 |

*Primary Examiner*—C. J. Husar
*Assistant Examiner*—Cherney S. Lieberman
*Attorney, Agent, or Firm*—Alfred D. Lobo

[57] ABSTRACT

A folding screen is formed by a plurality of successively hinged, rigid, radiation-controlling planar panels supported so the screen can be opened (or extended) and closed (or collapsed). Adjacent panels are supported only at their edges, by a hinge member having symmetrical back-to-back tubular channels. The hinge member possesses sufficient rigidity to permit hinged, side-by-side coaction of the panels from a stacked, generally vertical relationship when the screen is collapsed, to an undulating planar relationship when the screen is opened, which relationship is essential if the screen is to be collapsed without binding. The screen is translatable on a pair of parallel, mono-level tracks, and operated by a flexible drive member extending along a rail and connected to the screen's leading ("lead") panel.

A novel skylight includes a curb assembly, a "bubble" (or "dome") and a folding screen translatable to-and-fro below the bubble. The curb assembly is mounted on a curb provided on the roof, and the assembly includes an access panel which allows access to the folding screen housed in the assembly. The access panel is adjacent the skylight's bubble which is mounted on the walls of the curb assembly. This construction of the curb assembly permits maintenance of the folding screen without disturbing the seal of the bubble on the walls.

7 Claims, 6 Drawing Figures

FOLDING SCREEN FOR LIGHT-PERMEABLE SKYLIGHTS AND THE LIKE

BACKGROUND OF THE INVENTION

This invention relates to a folding screen useful in conjunction with transparent and translucent skylights, and roof panels of various types, all of which are designed to control the light and heat generated by the sun's rays, and are referred to generally as skylights. In particular, skylights transmit light in the range from about the near-infrared to about the near-ultraviolet regions, not all of which light is desirable all the time. The folding screen of U.S. Pat. No. 3,924,671, the disclosure of which is incoporated herein by reference as if fully set forth, is designed to control sunlight transmitted by a skylight. It was essential, for proper functioning of the screen, that adjacent hinges, each formed by interdigitation of longitudinal edges of the panels, be vertically displaced relative to one another, a principle of operation which is common to both the patented screen and our novel screen.

To maintain the relatively vertically displaced relationship of adjacent hinges, the patent provides a bi-level track on each side of the screen. In a first embodiment the bi-level track comprises a lower track and a vertical guiding lip; in a second embodiment the bi-level track comprises a lower track and an upper track. Roller means travel in the lower track; and on the upper track, washer or spacer means (in the first embodiment), and roller means (in the second embodiment), maintain the relative vertical displacement of the adjacent hinges. In relatively wide folding screens, particularly those having a width greater than about 6 feet, the patented screen required interdigitation of panels having a length corresponding to the width of the screen, and contiguous panels of such length have a tendency to bind when interdigitated, due to their weight which is supported only at the tracks at the ends of the panels. Also, notching a panel is not only technically difficult, but weakens the panel making it less rigid and thus increasing its tendency to bind. As a consequence, patented folding screens were made with arcuate panels which, because of their geometry, had the dual disadvantages of covering less area than planar panels for a given mass of extruded resin, and of occupying far too much space when the panels are stacked, (the screen's collapsed position). Moreover, rollers on the lower track are expensive to install, require too much maintenance to be attractive, and adherence to the principle of preventing the screen to assume a planar position necessitated a bi-level track, irrespective of the particular embodiment chosen, all of which further increased the expense of manufacturing the screen. It was the necessity of solving these problems economically which spurred the invention of the novel folding screen which now permits the use of planar panels, obviates the use of bi-level tracks, rollers and spacer means, and the necessity of interdigitating contiguous panels; and at the same time, simplifies its operation.

Various folding panel structures have been designed for diverse purposes such as garage doors, hatch covers, awnings, cabinet closures, and the like. Of necessity, each particular folding panel structure is directed to the specific purpose for which it is designed, is essentially complete taken alone, and neither requires nor suggests that any other reference's structure be utilized to supply additional features to help execute the function of that particular folding panel structure. This is to be expected since folding panel structures are used in a host of diverse industries wholly unrelated to one and another. A light-permeable radiation screen in particular, must be designed subject to myriad considerations so that it is as functional as it is compatible with a specific roof structure.

The folding screens of the prior art, as might be expected, disclose numerous ways to cope with the particular problems posed by: (a) the type and geometrical disposition of the opening to be screened, for example, a garage, swimming pool, shower stall, window, furniture cabinet, etc.; (b) the size and shape of the screen; (c) the guide means for the screen and how and where these guide means may be located; (d) the drive means to be employed to open and close the screen, whether manual or not; (e) the exposure of the screen to the elements; and, not less important than any of the foregoing among still other considerations, (f) the cost of manufacturing the folding screen.

A Venetian blind has been used as a skylight screen as disclosed in U.S. Pat. No. 3,265,117, to Lorentzen et al, with a ladder assembly or tapes, and strut-like members which act as mechanical ties. A retractable or foldable roof for covering a swimming pool is designed in U.S. Pat. No. 3,333,621 to Elder, to function as a load bearing structure which seals out wind, snow and rain. Though Elder does not define the problem, he has circumvented a problem similar to the one faced by applicants, namely, binding of the panels when the screen is to be collapsed after it is opened. Elder uses grooved wheels mounted coaxially with the hinge axis of an upper hinge, and grooved wheels mounted coaxially with the hinge axis of a lower hinge, which wheels are translatable along widely separate paths. The result is that the screen never assumes an undulating near-planar position.

A folding cover for a cabinet is disclosed in U.S. Pat. No. 3,570,579 to Matsushima. The cover is pendently supported and includes plural panels hingedly connected with a hinge of special design, which hinge permits adjacent panels to rotate through an angle of 120°. This rotation permits the panels to be folded in a stacked relationship, either vertically or horizontally, by virtue of the weight of the panels which commence to fold only after their weight is unsupported. The fitting slots in the specially designed hinge limits the rotation of a panel in only one direction, and this design is essential for the folding cover to assume a planar configuration when it is opened, this planar configuration being so essential that even the visible portions of the hinges are designed to preserve the planar appearance of the cover. However, the arcuate fitting slots cause binding of relatively long panels, that is, panels which are at least 3 feet long, such as are used for a folding screen for a skylight.

SUMMARY OF THE INVENTION

The present radiation screen is directed for use in conjunction with parallel, horizontal overhead mono-level tracks disposed beneath a bubble of a skylight or other transparent or translucent portion of a roof structure. A folding screen is formed with a plurality of hingedly connected, elongated, rigid, light-controlling panels having thickened longitudinal edges supported for to-and-fro translation in hinges in the overhead tracks. The screen may be stacked in a generally vertical configuration, or extended into an undulating, planar configuration beneath the bubble to control the amount of radiation which passes from the bubble to an area below the screen by virtue of the hinge members which are specially designed. One end panel adjacent one end of the tracks is fixedly disposed for pivotal movement about a longitudinal edge of the end panel, and the lead panel is connected to a flexible cable or similar drive means, preferably in a closed loop, which lead panel is subjected to sufficient force either to pull the screen into an extended position between one end of the tracks and the other, or to pull the screen into a stacked position. Where the skylight is inclined from the horizontal, the radiation screen may be supported in overhead tracks similarly inclinedly disposed beneath the bubble.

In a specific embodiment the radiation screen is supported for translation at an angle less than about 75° from the horizontal, on a linear rail provided in each overhead track integral with a support beam of the curb. Plural elongated, rigid upper and lower hinge members are each provided with back-to-back tubular twin channels, symmetrically disposed about a vertical plane, with a longitudinal slot in each channel. In one embodiment, either the upper or lower hinges, and preferably both, have the slot cut to a precise width, so that it has a camming action limiting movement of the panels when the screen is extended. The width of a camming slot is such that extended panels lie at an angle of from about 5° to about 30° to the horizontal, and preferably from about 10° to about 20°.

In another embodiment, the longitudinal slot is cut too wide to provide the necessary camming action, but not so wide that a thickened longitudinal edge of a panel can drop out of the slot. At least the upper hinge members are provided with a vertical web integral with the hinge, about which web the twin channels are symmetrically disposed. The height of the web is chosen so that, with the web resting vertically on the mono-level track, the screen, when extended, assumes an undulating planar configuration.

Irrespective of which embodiment of hinge member is used, the extended panels lie at the above-specified angle, and the screen is supported in successive hinge members, and at least alternate ones are always in turn always supported on a rail in each overhead track.

A novel curb assembly for a skylight, which skylight includes a dome (or "bubble") and folding screen below the bubble, is provided with an access panel for the folding screen which is housed in the curb assembly. The access panel is adjacent the skylight's "bubble" which is mounted on the walls of the curb assembly. This construction of the curb assembly permits maintenance of the folding screen without disturbing the seal of the bubble on the walls.

DETAILED DESCRIPTION OF THE INVENTION

The skylight of this invention is an all-seasons skylight with a motor driven light-permeable shade to control sunlight and solar heat gain. Each unit is double-glazed, the side walls are insulated, and the curb assembly is designed with thermo-barriers to minimize through-metal conduction of heat. The skylight allows one to design a room for the level of outdoor light desired for esthetic and environmental reasons while permitting energy conservation through the control of solar heat gain. The system operates on available current whether 115 or 220 volts; controls for the system operate on 24 volts circuitry.

Figure 1:
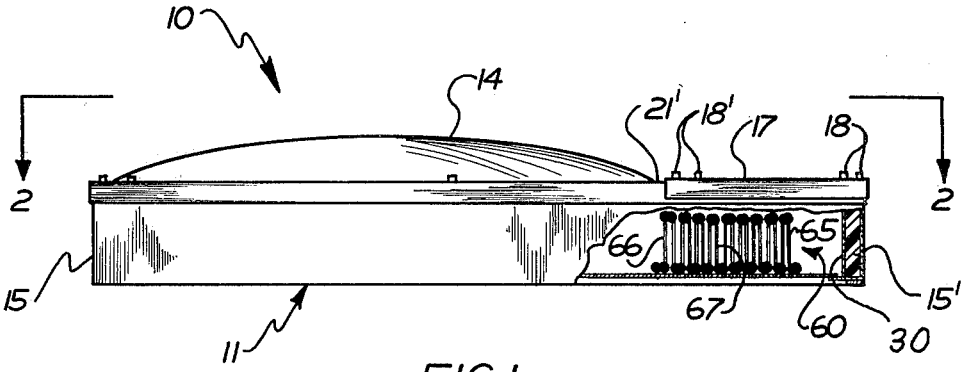
FIG. 1 is a front elevational view with a portion broken away, of a rectangular bubble in a skylight in which a collapsed radiation screen is housed.
Figure 2:
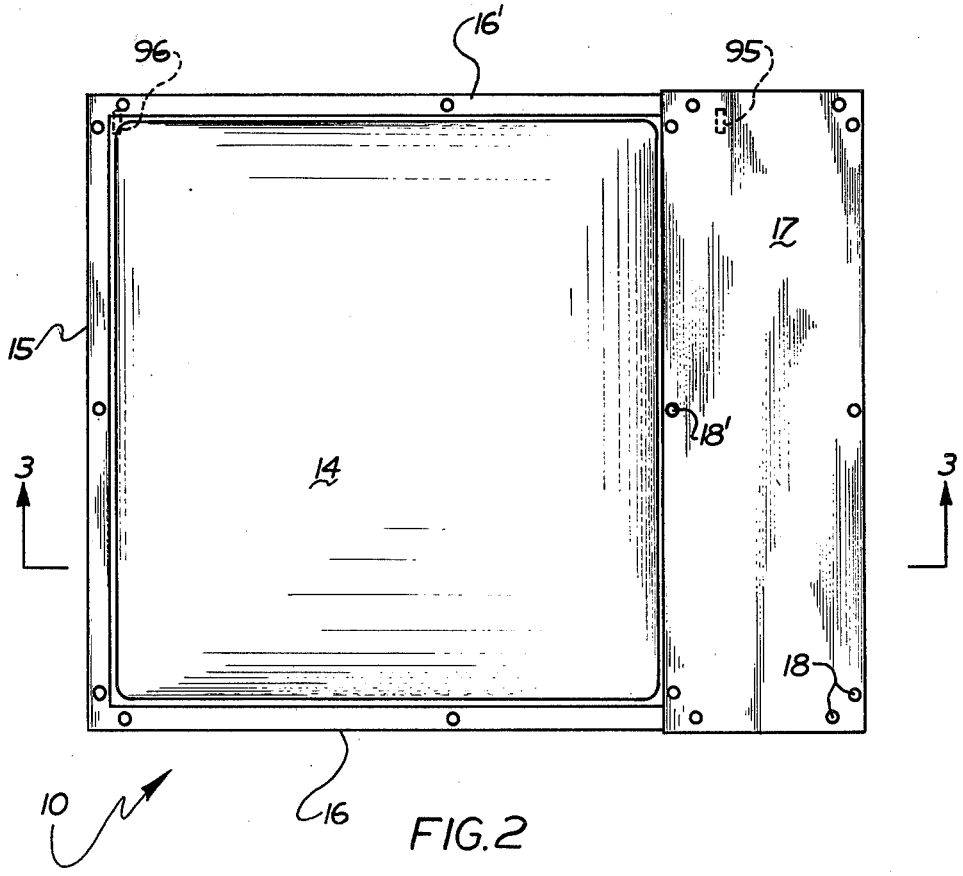
FIG. 2 is a plan view of the bubble and skylight shown in FIG. 1.
Figure 3:
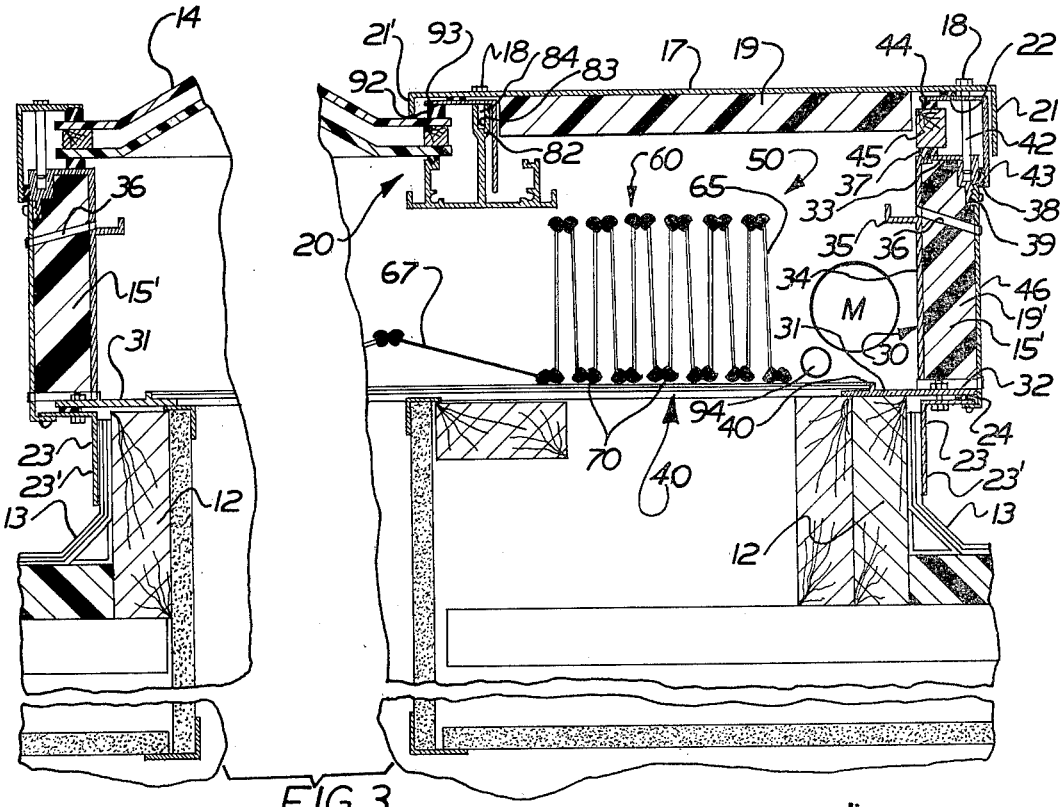
FIG. 3 is a side elevation cross-sectional view along the line 3—3, with the central portion broken away, diagrammatically illustrating the radiation screen showing details of the side walls of the curb assembly on which the rectangular bubble is disposed, the screen being shown partially collapsed, and partially extended in an undulating planar configuration.

Referring to the drawings, and particularly to FIGS 1–3, and 6, there is shown in FIG. 1 a front elevational view with a portion broken away, of a skylight, indicated generally by reference numeral 10, which includes a curb assembly indicated generally by reference numeral 11, mounted on a curb 12 provided in a roof. Roof material 13 is "flashed" up against the wall of the curb 12, usually a wood framework, and nailed to it in a conventional manner. The skylight 10 also includes a rectangular bubble 14, preferably one with a twin-wall for better insulation, which bubble is typically transparent or translucent to sunlight. The bubble 14 is mounted on one side of the curb assembly, on three walls, namely, on one end wall 15 (of two end walls indicated generally by reference numerals 15 and 15'), and side walls indicated generally by reference numerals 16 and 16'. An access panel 17 is mounted adjacent the bubble 14, on the other end wall 15', and side walls 16 and 16', with bolts 18. The access panel 17 is preferably insulated with a foam insulation 19 and provided with a flange 21 which fits snugly over end wall 15', and side walls 16 and 16', as shown in FIGS. 1 and 3, to ensure a weather-tight seal against leakage of air and water. A gasket means 22 helps provide the desired seal.

Each end wall and side wall of the curb assembly 11 is similarly constructed. Each wall includes a right angle member 23 which is sealingly fitted to a wall of the curb 12 so that vertical portion 23' of the angle member tightly holds roof material 13 against the wall of the curb. Horizontal portion 23'' (shown in FIG. 6) of the right angle member 23 is gasketed with a gasket 24 which forms a thermo-barrier when bolted to a support beam, indicated generally by reference numeral 30. Each end wall and side wall of the curb assembly 11 includes a support beam 30.

The support beam 30 comprises a base having an internal planar portion 31 and an external portion 32, both in the same horizontal plane. The internal portion 31 functions as a mono-level track upon which a folding screen, indicated generally by reference numeral 50, is translatably disposed so that it can be extended from its position under access panel 17 to opposite end wall 15, and then retracted or collapsed under the access panel. The folding screen 50 is made up of a plurality of planar panels, indicated generally by reference numeral 60, hinged together with hinge members, indicated generally by reference numeral 70. To decrease friction, it is preferred to provide a rail 40 on the internal portion 31, and the lower hinge members 70' are supported on the rail. Alternatively, the lower hinge members may be provided with rollers which provide low-friction movement though the rollers rest directly upon the mono-level track. It will be evident that the lower hinges are always supported on the track. Upper hinges 70'' may or may not be supported on the track when the panels are extended, depending upon which embodiment of hinge member is chosen. The drive means for opening and closing the screen includes an electric motor M. The manner in which the screen operates, and details of the construction of the panels and the hinges, will be described further hereinafter.

Figure 6:
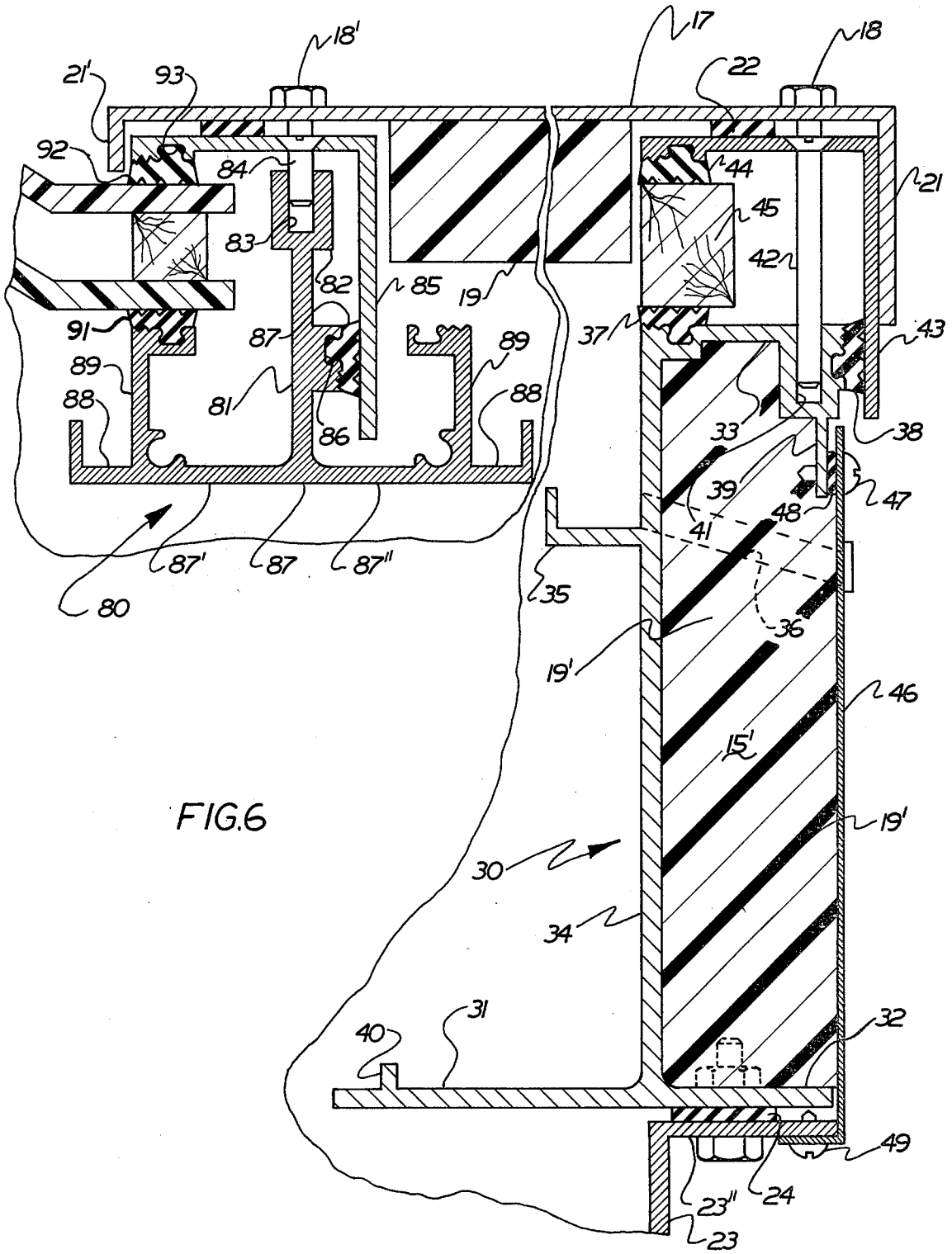
FIG. 6 is an enlarged detail view of the skylight and the central support member shown in FIG. 3, and of the end wall also shown in FIG. 3, with portions of the skylight broken away to show details of construction.

The support beam 30 also includes an upper stepped flange portion 33 which extends horizontally and outwardly from a vertical web 34 which connects the portion 33 to the base portions 31 and 32 (see FIG. 6). A gutter 35 is provided on the web 34, interiorly thereof, to collect condensate which is drained out of the walls through a condensate passage 36 provided therein. Flange portion 33 is grooved to accept gaskets 37 and 38, and includes a pendent vertical flange 39, and several fasteners 42 are self-threaded in the channel 41. Each self-threaded fastener 42 secures a right angle upper cap 43 fitted with a gasket 44 against an elongated spacer 45, and also against gasket 38, so as to form a weather tight seal. The vertical flange 39 serves to anchor a side cap 46 with screws 47 which secure a thermo-barrier gasket 48 between the flange and side cap. Machine screws 49 are used to secure the side cap 46 to the horizontal flange portion 23'' of the right angle member 23. The right angle member 23, the support beam 30, the upper cap 43, and the side cap 46 are all preferably formed from aluminum extrudates. Foam insulation 19' fills the space enclosed within each end wall and side wall.

Figure 4:
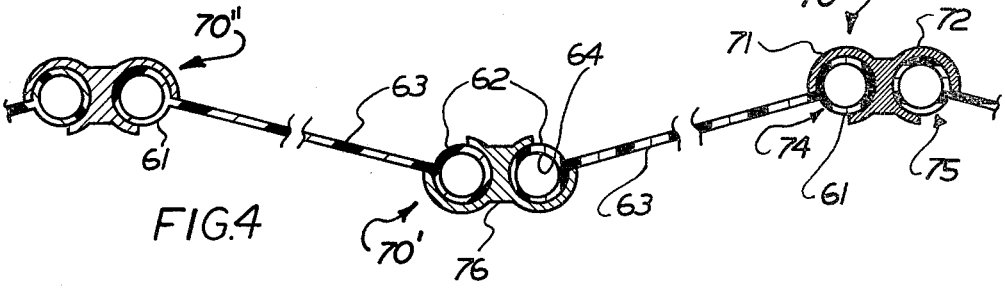
FIG. 4 is a detail view in cross section, of upper and lower hinges without a web member, the hinges connecting adjacent panels, and camming slots in the hinges limiting movement of the panels.
Figure 5:
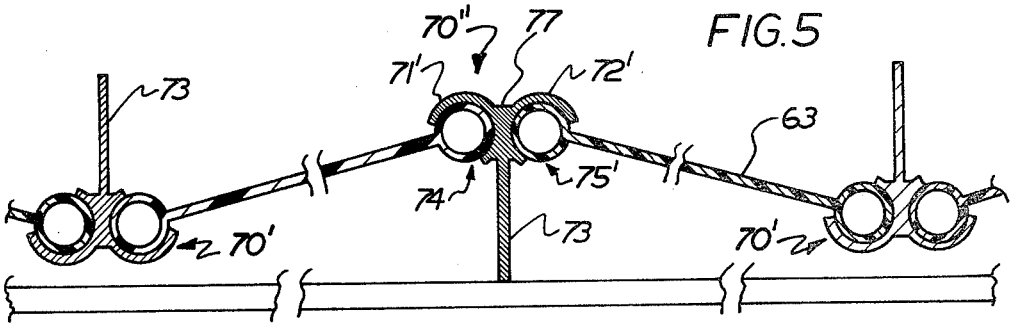
FIG. 5 is a detail view in cross section of upper and lower hinges including a web member, the hinges connecting adjacent panels, when the camming slots in the hinges are too wide to provide a camming function, but where the height of the web of the hinge prevents the screen from assuming a planar configuration.

Referring now to the folding screen 50, and particularly to FIGS. 4 and 5, it is made up of a plurality of rigid, light-controlling planar panels 60. By "rigid" I refer to a lack of noticeable deflection of a panel under its own weight, when the panel is supported along its thickened longitudinal edges 61 and 62 which extend continuously along each side of a strip 63. Each thickened edge is preferably provided with a longitudinal axial bore 64 to save material. Each panel strip is from about 8 cm to about 20 cm wide and from about 2 mm to about 5 mm thick. As will be evident, wider strips will normally require greater thickness for rigidity, but the strips may be provided with stiffening ribs (not shown) if desired. The thickened edges 61 and 62 are preferably cylindrical in cross section having an outside diameter in the range from about 5 mm to about 1 cm depending on the width and length of the panels. The panels are preferably cut to a preselected length about the width of the bubble, from an extrudate of synthetic resinous material such as poly(methyl-methacrylate), poly(vinyl chloride), or the like, preferably stabilized with ultraviolet light stabilizers. Alternatively, a strip may be extruded, and then transverse stiffening ribs (which cannot be extruded on the strip), and longitudinal edges solvent-welded thereon.

The length of the panels, and therefore the width of the folding screen, is limited only by the practical considerations of forming a sufficiently rigid panel within the framework of the dimensional requirements of the skylight and its folding screen. Also, the materials from which the panels are formed are not limited to extruded plastic materials. The panels may also be made of translucent glass fiber reinfoced plastic, or from tinted glass. However, the ease with which glass may be extruded, and tinted, is offset by the difficulty of handling it. The choice of material depends upon its ability to maintain a predetermined radiation permeability, and the cost of forming a panel of desired dimensions. By predetermined radiation permeability is meant a preselected desirable characteristic of the material from which the panel is formed, both with respect to the intensity and the range of wavelengths of heat and light radiation to which the panel is permeable.

As indicated hereinabove, bubble 14 and access panel 17 are mounted adjacent one and another on the curb assembly 11, bubble 14 being sealed and supported on end wall 15 and side walls 16 and 16', and, the access panel being sealed and supported on end wall 15' and side walls 16 and 16'. Adjacent edges of the bubble and the access panel are supported on a cross-member 80 which in turn is supported at each end by the condensate gutters 35 of the side walls 16 and 16'. It will now be seen that the gutters 35 of the side walls are so located as to support the bubble and access panel coplanarly with the upper surfaces of the end walls 15 and 15' and side walls 16 and 16'. The cross-member 80 includes a central vertical support member 81 having an upper channel member 82 having a longitudinal channel 83 in which there is provided several self-threaded fasteners 84, a right which fasteners secure a right angle cap 85, preferably having the same cross section as upper cap 43. Central support member 81 is provided with a groove 86 in which a neoprene gasket 87 is held, and, with a base 87 having portions 87' and 87'' symmetrically disposed about the support member 81. Each portion includes a condensate gutter 88 and a vertical support member 89, one of which vertical support members is fitted with a neoprene gasket 91. A similar gasket 92 is directly oppositely disposed in a groove 93 provided in the right angle cap 85, so that bubble 14 is tightly held between gaskets 91 and 92. Flange 21' of the access panel preferably fits over and exteriorly of, the gasket 92. Thus, bubble 14 is sealed against the weather on the cross-member 80. Condensate from the gutters 88 of the cross-member 80 drains into the gutters 35 of the side walls, and is disposed of outside the skylight.

Referring further to FIGS. 1 and 3, the folding screen 50 includes a pivot panel 65 pivotable about a fixed lower edge, and a lead panel 66 connected by a seies of intermediate panels 67, all shown in a generally vertical stacked configuration when the screen is collapsed. The panels are hingedly connected successively, for side-by-side coaction with hinge members 70, along opposite longitudinal edges of the panels. The lower edge of lead panel 66 is also inserted in a hinge 70, for better to-and-fro translation of the screen.

Though all hinge members 70 are conveniently cut from the same extruded stock, and are essentially identical, for the sake of clarity, lower hinge members are referred to by reference numeral 70' and upper hinge members are referred to by reference numeral 70''. The screen rests at all times on the lower hinges 70' which in turn rest on the rail 40. In the stacked essentially vertical configuration, upper hinges 70'' are vertically spaced apart from lower hinges 70' by substantially the width of a panel, and in the extended configuration, alternate hinges are vertically spaced apart by at least the height of the web 73, if the camming slots are cut too wide to provide a camming function. If the camming slots are cut to provide a camming function, that is, to maintain a predetermined angle of repose for the panels when the screen is extended, the vertically spaced apart relationship of the upper and lower hinges is determined by the predetermined angle. The predetermined angle may be chosen such that the vertically spaced apart relationship of the upper and lower hinges is greater than the height of the web 73, and in such a case the web 73 may be used simply to provide additional rigidity to the hinge members.

The lead panel 66 is connected by a lug (not shown) on its hinge 70' to a cable which is trained over an idler pulley mounted on the side wall towards which the screen is extended, and returned so as to form a closed loop to open and close the folding screen, as is conventional, and which is more specifically described in U.S. Pat. No. 3,924,671. Though the folding screen of our invention may be manually operated, it is preferred to use a motor means to open and close the screen. This is accomplished by at least one, and preferably two closed loop chains drivingly trained on a pair of sprockets 94, one at each end of a shaft which extends the width of the screen, which sprockets are reversibly rotatable with an electric motor means indicated by reference symbol M. Idler sprockets (not shown) are positioned opposite each drive sprocket, on the opposite side wall of the curb assembly. It is further preferred to use any conventional chain tensioning means, either on the idler sprocket which may be spring biased, or directly as part of the chain itself, to prevent the chain from dragging on the internal portion 31 when the screen is opened and closed. Limit switches 95 and 96 are provided, one at each end of the screen, to stop rotation of electric motor M and drive sprockets 94 when the screen is either fully extended, or fully collapsed. The means for opening and closing the screen are well-known to those skilled in the art, and therefore are not described in greater detail. It is important however, to note that the drive for the screen is simplified, requiring no spring biasing means on the panels, because the construction of the hinges permits the screen to be opened to an undulating, near-planar configuration, but never allows the screen to become planar. If the screen were permitted to be opened into a planar configuration, it could not thereafter be closed with the drive mechanism described, because it would jam.

A panel 60 is inserted in a hinge 70 by inserting an end of a thickened longitudinal edge 61 or 62 in the end of the channel, and sliding the edge longitudinally into the channel. The panels cannot be pulled out of the slots by pulling the panels directly outward, but only by sliding the panel out of the channels, in a reverse manner from that required for insertion of the panels. It is preferred that the camming slots are also symmetrical about the vertical axis, for practical purposes. Two specific embodiments of the hinge member 70 are illustrated in enlarged cross-sectional views in FIGS. 4 and 5. In FIG. 4, hinge member 70 is indicated for clarity, by reference numeral 76, and in FIG. 5 by reference numeral 77; also, reference numerals for channels and slots in FIG. 5 are primed to indicate they may be dimensionally different from those illustrated in FIG. 4.

Referring first to FIG. 4, hinge 76 comprises back-to-back twin tubular channels 71 and 72 symmetrically disposed about a vertical axis. Each channel has an internal diameter large enough to slidably accomodate a thickened edge 61 or 62 of the panels. Camming slots 74 and 75, each narrower than the outside diameter of a panel edge, are cut longitudinally along the entire length of channels 71 and 72 respectively. Each slot, cut in each channel provides a camming function because it limits the movement of the hingedly connected panels, when the screen is extended, so that a panel is never less than 5° from the horizontal, and more preferably, is not less than about 10° from the horizontal, though it may be as much as 30°. Thus, the upper edges of camming slots 74 and 75 abut against the upper surface of strip 63 of each panel and limit the panels' further movement. When the panels are stacked, the slots permit the panels to assume an upstanding, essentially vertical position.

It will now be evident that when the slots do provide a camming function, it is not essential that both the upper and lower hinges have camming slots. It is sufficient if either the upper hinges or the lower hinges have slots which provide a camming function, since the camming action of a single slot, whether it is on the upper or lower hinge, will limit the movement of the panel. Of course, from a practical point of view, all hinges would be extruded with the same cross-section, and the width of the slots would be the same in both the upper and lower hinges. However, referring to FIG. 3, it will be seen that if the upper edges of the camming slots of the upper hinges 70'' cam against the upper surface of strip 63, then the slots of lower hinge 70' may be wider, so that the lower edges of the slots do not cam against the lower surface of the strip 63. In other words, if the slots of the upper hinges 70'' provide a camming function, the slots of the lower hinges 70' serve simply as slots to provide free movement of the panel from an essentially vertical position when the panels are stacked, to a horizontal position when the screen is extended, provide of course that the panels do not come out of the slots.

Referring now to FIG. 5, hinge 77 comprises back-to-back twin tubular channels 71' and 72' symmetrically disposed about a vertical web 73. As before, each channel slidably accomodates edges 61 and 62 of the panels, and camming slots 74' and 75' are cut longitudinally along the entire length of each channel. The width of the camming slots is not critical because the web 73 acts as a spacer and does not require that the slots provide a camming function. However, if the slots are cut too wide, that is, wider than the maximum diameter of a thickened edge of a panel, the panel will drop out. The height of the web member 73 is chosen to prevent the screen from being opened into a planar configuration, and to limit the extension of the screen to an undulating planar configuration. As before, a panel is never less than 5° from the horizontal, and is preferably less than 30° from the horizontal. It will be evident that the more nearly planar the extended form of the screen, the less material is used, and it is preferred to maintain the extended panels at about 10° from the horizontal. Also as before, when the panels are stacked, the slots permit the panels to assume an upstanding, near-vertical position.

As illustrated in FIGS. 4 and 5, the channels are back-to-back, that is, there is substantially less stock (preferably aluminum) displacing the outside surfaces of each channel from one and another than the outside diameter of a channel, otherwise the opening and closing action of the screen will be impaired. Each hinge 76 and 77 is preferably made from metal so that it is substantially rigid, that is, the hinges do not permit sufficient deflection of the panels, due to their weight, to interfere with the action of the screen. Since it is convenient to manufacture the hinges by extruding aluminum, it is preferred to enhance the rigidity of each hinge with the vertical web 73, which web would be unnecessary if the back-to-back channels were sufficiently rigid without it. Since it is difficult to maintain tolerances when cutting camming slots of precise width to provide the desired camming function, it is preferred to provide the web 73 on hinges to serve as a spacer which provides the precise necessary vertical displacement of alternate hinges, when the screen is extended, to give it the required undulating planar configuration. It has earlier been stated that the screen is made up of light-controlling panels. It will now be evident that the panels will typically be tinted so as to control direct sunlight transmitted through the bubble. However, the panels may also be provided with reflectorized upper surfaces which may reflect some or all of the transmitted light. If no light is to be transmitted into the room, the panels may be made from opaque material such as aluminum.

We claim:

1. In a folding radiation screen having predetermined permeability to sunlight, which screen may be partially or fully extended beneath a bubble in a skylight or light-permeable roof structure, and which comprises, a plurality of rigid planar elongated panels having thickened longitudinal edges successively hinged together for co-action in side-by-side relationship; parallel overhead track means inclinedly disposed at an angle less than 75° with respect to the horizontal, to support said screen for to-and-fro translation between one end of said track means and the other; an end panel pivotable about a fixed lower edge adjacent said one end of said track means; and drive means to open and close said screen, the improvement comprising, (a) mono-level track means supporting opposite ends of each of said panels, (b) plural elongated rigid hinge members each having (i) back-to-back tubular twin channels symmetrically disposed about a vertical axis, said channels each having one thickened longitudinal edge of successive panels slidably disposed in each channel, and, (ii) longitudinal camming slot means in each channel of preselected hinge members, said camming slot means having a width such that an edge limits movement of a panel so that when said screen is extended, extended panels lie at an angle from about 5° to about 30° to the horizontal, in an undulating planar configuration which allows said screen to be collapsed into an upstanding generally vertical configuration, after it has been retracted.

2. The folding screen of claim 1 wherein said mono-level track means includes a rail on which lower hinges of said screen are translatably disposed.

3. The apparatus of claim 1 wherein said skylight includes a curb assembly weather-tightly mounted on a curb in a roof structure, and comprises an access panel removably secured on said curb assembly adjacent said bubble, to provide access to said screen and to said drive means which open and close said screen, without removing said bubble.

4. In a folding radiation screen having predetermined permeability to sunlight, which screen may be partially or fully extended beneath a bubble in a skylight or light-permeable roof structure, and which comprises, a plurality of rigid planar elongated panels having thickened longitudinal edges successively hinged together for co-action in side-by-side relationship; parallel overhead track means inclinedly disposed at an angle less than 75° with respect to the horizontal, to support said screen for to-and-fro translation between one end of said track means and the other; an end panel pivotable about a fixed lower edge adjacent said one end of said track means; and drive means to open and close said screen, the improvement comprising, (a) mono-level track means supporting opposite ends of each of said panels, (b) plural elongated rigid hinge members each having (i) back-to-back tubular twin channels symmetrically disposed about a vertical axis, said channels each having one thickened longitudinal edge of successive panels slidably disposed in each channel, and, (ii) a longitudinal slot in each channel of all hinge members, said slot having a width less than the outside diameter of said thickened edges of a panel, but sufficient to permit successive panels to be stacked in an upstanding nearly vertical position when the screen is collapsed, and to be extended to an undulating planar configuration when the screen is extended, and, (iii) a vertical web integral with said hinge member, about which web said twin channels are symmetrically disposed, said web when resting upon said track means, having a height sufficient to provide said undulating planar configuration of the screen when the panels are extended, so that extended panels lie at an angle from about 5° to about 30° to the horizontal, whereby said undulating planar configuration allows said screen to be collapsed into an upstanding generally vertical configuration, after the screen has been retracted.

5. The folding radiation screen of claim 4 wherein said mono-level track means includes a rail on which lower hinges are translatably disposed.

6. The folding radiation screen of claim 4 wherein said panels lie at angle from about 10° to about 20° to the horizontal.

7. The apparatus of claim 4 wherein said skylight includes a curb assembly weather-tightly mounted on a curb in a roof structure, and comprises an access panel removably secured on said curb assembly adjacent said bubble, to provide access to said screen and to said drive means which open and close said screen, without removing said bubble.

* * * * *